US006507960B1

(12) United States Patent
Kelly

(10) Patent No.: US 6,507,960 B1
(45) Date of Patent: Jan. 21, 2003

(54) BATH SAFETY FIXTURE

(76) Inventor: Eugene A. Kelly, 731 Kelly Rd., Bladenboro, NC (US) 28320

( * ) Notice: Subject to any disclaimer, the term of this patent is extended or adjusted under 35 U.S.C. 154(b) by 0 days.

(21) Appl. No.: 10/139,723

(22) Filed: May 6, 2002

Related U.S. Application Data

(62) Division of application No. 09/928,300, filed on Aug. 13, 2001, now Pat. No. 6,381,771.

(51) Int. Cl.[7] ..... A47K 3/022
(52) U.S. Cl. ..... 4/576.1
(58) Field of Search ..... 4/559, 576.1; 211/105.1, 211/119.009, 119.011, 123; 248/251

(56) References Cited

U.S. PATENT DOCUMENTS

| | | | |
|---|---|---|---|
| 1,706,683 | A | 3/1929 | Victorsohn |
| 2,484,021 | A | 10/1949 | Eoves |
| 2,689,103 | A | 9/1954 | Ackerman |
| 2,923,013 | A | 2/1960 | Wasserman |
| 3,430,908 | A | 3/1969 | Kowalczyk |
| 4,361,915 | A | 12/1982 | Siewert |
| 4,461,056 | A | 7/1984 | Solinski |
| 4,775,056 | A | 10/1988 | Inglis |
| 5,345,623 | A | 9/1994 | Dearman |
| 5,351,739 | A | 10/1994 | Levy |
| 5,810,180 | A | 9/1998 | Chan |
| 5,970,535 | A | 10/1999 | Wayne |
| 6,112,344 | A | 9/2000 | Guenther |

*Primary Examiner*—Charles E. Phillips
(74) *Attorney, Agent, or Firm*—Donald R. Schoonover

(57) ABSTRACT

A safety fixture includes mounting brackets that are mounted on the walls adjacent to a tub or shower and support a support bar that extends for the length of the tub or width of the shower. The mounting brackets include a plurality of spaced apart support bar accommodating channels so the support bar can be moved into a position that is most efficient for a user. The support bar includes a knurled outer surface and a mounting flange can be included on each mounting bracket to support a curtain rod.

3 Claims, 2 Drawing Sheets

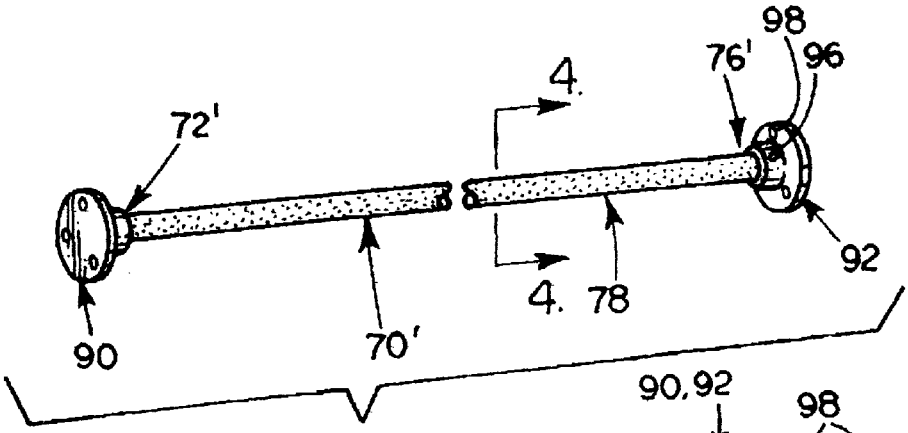
FIG. 3.
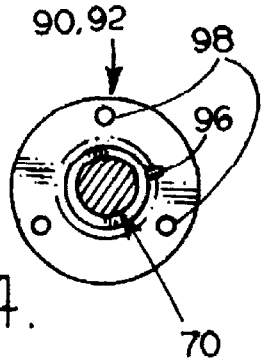
FIG. 4.
FIG. 7.
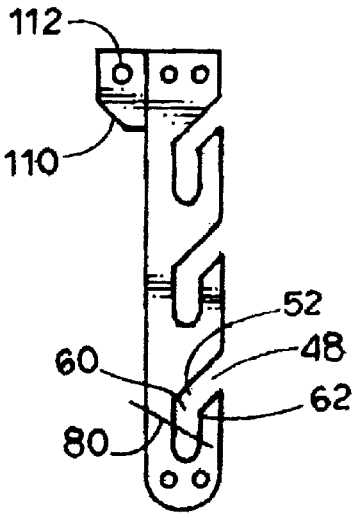
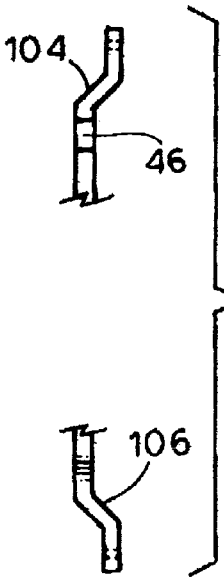
FIG. 6.
FIG. 5.
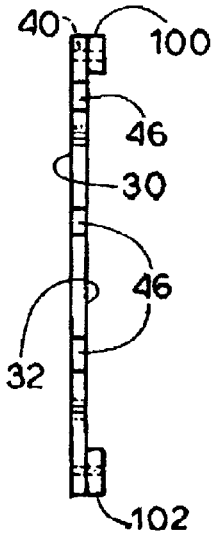

BATH SAFETY FIXTURE

CROSS REFERENCE TO RELATED APPLICATIONS

This is a division of Ser. No. 09/928,300, filed Aug. 13, 2001, now U.S. Pat. No. 6,381,771B1.

BACKGROUND OF THE INVENTION

1. Field of the Invention

The present invention relates to the general bath and shower art, and to the particular field of safety devices for use in a bath or shower.

2. Discussion of the Related Art

Each year hundreds, if not thousands, of people are injured in falls in the shower or bathtub. These injuries range from slight bruises to broken bones and even death. The injured range in age from young children to elderly people and the injuries are often caused by slipping or simply losing balance. As is well documented, elderly people are far more likely to fall in the bathtub than are young people and are far more susceptible to serious injury than young people.

For these reasons, many hotels and motels install some sort of support bar on a wall near a shower so people using the shower have a hand hold when entering or exiting the shower or tub.

While these support bars work well for some people entering or exiting the shower or tub, they are not always located in the most advantageous position. For example, a person seeking to enter or exit a shower or tub near the center of the shower of tub will not have ready access to a support bar located on one end of the shower of tub. Even if the support bar is located near the center of the tub, if it is mounted on a wall someone entering the tub will have to reach across the tub to grasp the bar. This is awkward, especially for an elderly person.

Therefore, there is a need for a safety fixture that is located for easy access by someone entering or exiting a tub.

Still further, the support bars presently in use are generally firmly fixed in one position with respect to the bath or tub. While this is convenient for installation, it is not always conveniently used by the user. A perfect height for one person may be too high or too low for another person. If a safety bar is not in a convenient location, it may not be used at all or it may be inefficient, and hence ineffective, for use. Thus, most if not all known safety bars do not fully account for the user's needs.

Therefore, there is a need for a safety fixture that is amendable to meeting a wide variety of user needs.

Most presently known safety bars are designed for easy installation and maintenance as much as for ease of use. Therefore, there is a need for a safety fixture that takes more account of user needs than presently known safety fixtures.

Still further, many known safety bars have smooth finishes. Again, while this presents an attractive aesthetic appearance and is easy to clean, it is not the most efficient design for the user. A smooth finish may be slippery and a user, especially an elderly user who is falling, may grasp the safety bar and still suffer a nasty fall because he or she had their grip slip from the safety bar. As above, the user's needs have not been fully accounted for or made subservient to installation and/or maintenance requirements.

Therefore, there is a need for a safety fixture that has a surface that provides a slip-free surface.

OBJECTS OF THE INVENTION

It is a main object of the present invention to provide a safety fixture that is located for easy access by someone entering or exiting a tub.

It is another object of the present invention to provide a safety fixture that is amendable to meeting a wide variety of user needs.

It is another object of the present invention to provide a safety fixture that takes more account of user needs than presently known safety fixtures.

It is another object of the present invention to provide a safety fixture that has a surface that provides a slip-free surface.

SUMMARY OF THE INVENTION

These, and other, objects are achieved by a safety fixture that is mounted near a tub or shower to extend along the full length of the tub or width of a shower at a location where it is most likely to be used to enter or exit the tub or shower or to be most accessible in the event of a fall. The fixture is movable into a position most advantageous for a user, and once in such position, will be securely mounted. The fixture also has a non-slip surface so once grasped, the grasp is not likely to slip.

BRIEF DESCRIPTION OF THE DRAWINGS

FIG. 3 is a perspective view of an alternative form of the bath safety fixture embodying the teaching of the present invention.

FIG. 4 is an elevational view of the bath safety fixture, taken along line 4—4 of FIG. 3.

FIG. 5 is a side elevational view of another form of the mounting bracket of the safety fixture of the present invention.

FIG. 6 is a side elevational view of another form of the mounting bracket.

FIG. 7 is a front elevational view of another form of the mounting bracket.

DETAILED DESCRIPTION OF THE INVENTION

Figures 1, 2:
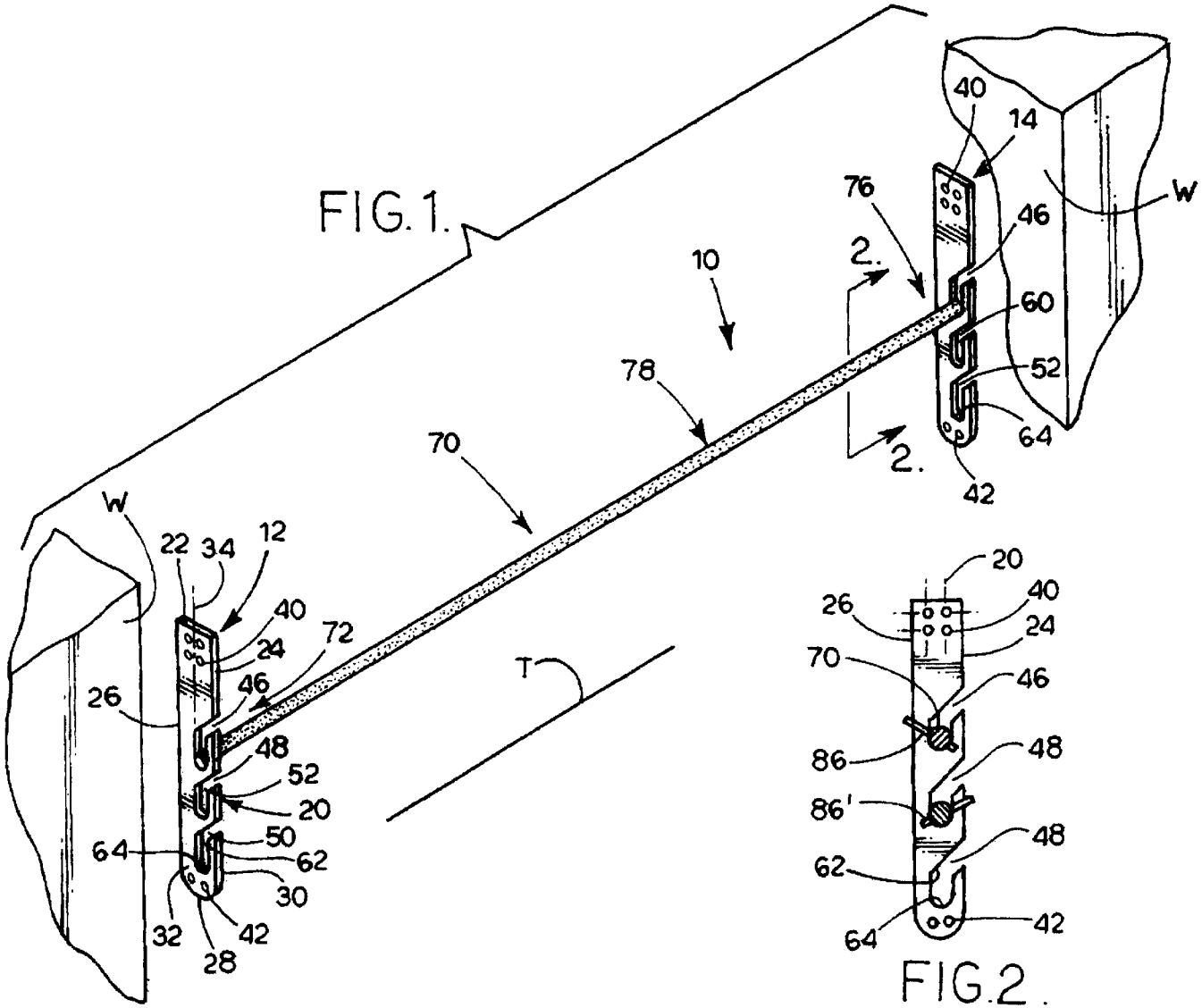
FIG. 1 is a perspective view of a bath safety fixture embodying the teaching of the present invention.
FIG. 2 is an elevational view of the bath safety fixture, taken along line 2—2 of FIG. 1.

Other objects, features and advantages of the invention will become apparent from a consideration of the following detailed description and the accompanying drawings.

The safety fixture of the present invention can be used in a bath or shower and is designed to be positionable so as to be located in the most useful location and to be easily accessible to anyone using the bath or shower.

Specifically, a bath safety fixture 10 is shown in FIGS. 1 and 2 as comprising first and second mounting brackets 12 and 14 respectively which are fixedly mounted on a wall W of a shower or bath when in use adjacent to a tub T to extend along the full length of the tub adjacent to where a user will enter or exit the tub. Thus, if the tub is located in a corner of a room with one side of the tub being stepped over to enter or exit the tub, fixture 10 is located adjacent to the side of the tub that is stepped over, that is, the side of the tub that will generally also have a shower curtain. Thus, the fixture will extend from one end wall to the other and be spaced from the third wall associated with the tub as can be visualized by one skilled in the art based on the teaching of this disclosure. The mounting brackets 12, 14 are identical, and thus only one bracket, mounting bracket 12, will be described, it being understood that the description applies to mounting bracket 14 as well. Each mounting bracket 12 includes an elongate body 20 having a top end 22, first and second side edges 24 and 26 respectively, a bottom end 28, an outer surface 30 which will face outwardly from wall W when the bracket 12 is mounted on wall W, a wall-facing surface 32 which will face wall W when the mounting bracket 12 is fixedly mounted on wall W. Each mounting bracket 12 further includes a longitudinal centerline 34 extending between first and second ends 22 and 28 respectively of elongate body 20 of each mounting bracket 12.

Each mounting bracket 12 further generally includes a plurality of top end fastener-receiving holes, such as top end fastener-receiving hole 40 defined through elongate body 20 from outer surface 30 to wall-facing surface 32 of each mounting bracket 12 near the top end 22 of the elongate body 20 of each mounting bracket 12. Each mounting bracket 12 further generally includes a plurality of bottom end fastener-receiving holes such as bottom end fastener-receiving hole 42 defined through the elongate body 20 from the outer surface 30 to the wall-facing surface 32 of each mounting bracket 12 near bottom end 28 of the elongate body 20 of each mounting bracket 12. Fasteners (not shown), such as screws or the like, will extend through the fastener-receiving holes 40, 42 and into wall W to fixedly attach the mounting bracket 12 to the wall.

As can be seen in FIG. 1, each mounting bracket 12 further includes a plurality of first channels, such as channel 46, extending through elongate body 20 from outer surface 30 to wall-facing surface 32 of the elongate body 20 of each mounting bracket 12. Each first channel 46 includes an entrance opening 48 in first side edge 24 of the elongate body 20 of each mounting bracket 12 and a body portion 50 extending from entrance opening 46 toward second side edge 26 of the elongate body 20 of each mounting bracket 12 at an oblique angle to first side edge 24, and an exit opening 52 located near longitudinal centerline 34 of the elongate body of each mounting bracket 12. The first channels 46 are spaced apart from each other along first side edge 24 of the elongate body 20 of each mounting bracket 12 for a purpose that will be understood from the following discussion.

Each mounting bracket 12 further includes a plurality of second channels, such as channel 60 extending through the elongate body 20 of each mounting bracket 12 from the outer surface 30 to the wall-facing surface 32 of the elongate body 20 of each mounting bracket 12. Each second channel 60 includes an entrance end 62 in open communication with an exit opening 52 of a corresponding first channel 46, and a closed bottom end 64. Each second channel 60 extends in the direction of longitudinal centerline 34 of the elongate body 20 of each mounting bracket 12. As can be seen in FIGS. 1 and 2, the second channels 60 are spaced apart from each other along longitudinal centerline 34 of the elongate body 20.

Safety fixture 10 further includes a support bar 70 extending from first mounting bracket 12 to second mounting bracket 14 when in use and includes a first end 72 supported on a closed bottom end 64 of one of the second channels 60 of first mounting bracket 12 and a second end 76 supported on a closed bottom end 64 of a corresponding one of the second channels 60 of second mounting bracket 14 when in use. Support bar 70 includes a knurled outer surface 78. Support bar 70 further includes a first locking pin receiving hole extending through the support bar near first end 72 of the support bar, and a second locking pin receiving hole extending through the support bar near second end 76 of the support bar.

As can be seen in FIG. 2, a first locking pin 86 is accommodated in the first locking pin receiving hole on support bar 70 and abuts wall-facing surface 32 of first mounting bracket 12 when support bar 70 is supported on first mounting bracket 12. A second locking pin (not shown) is similar to the just-described first locking pin 86 and is accommodated in the second locking pin receiving hole on support bar 70 and abuts the wall-facing surface 32 of second mounting bracket 14 when support bar 70 is supported on second mounting bracket 14.

As can be understood from the foregoing, the spaced-apart positioning of the channels 46 permits support bar 70 to be located in any one of several positions on the mounting brackets 12, 14. This permits the support bar 70 to be placed in the position that is most advantageous to a user. Once in place, the support bar 70 will be securely held by the mounting brackets 12, 14. While three support positions are shown, it is understood that more than three or only two can be used without departing from the scope of the present disclosure. The entranceways provided by first channels 46 permit easy placement and removal of the support bar 70 as desired. However, the orientation of the second channels 60 will securely hold the support bar 70 in place. To emphasize this positionable feature of the present invention, two positions for a support bar are shown.

An alternative form of the support bar is shown in FIGS. 3 and 4. Support bar 70' also includes a knurled surface 78 and the remainder of a safety fixture system including support bar 70' is identical to that discussed above with regard to system 10. Accordingly, only the differences between support bar 70 and support bar 70' will be discussed with the above discussion being incorporated by reference for the remainder of the safety fixture which includes support bar 70'. As shown in FIGS. 3 and 4, support bar 70' includes a first locking cap 90 on first end 72' of support bar 70' and abuts the wall-facing surface 32 of the first mounting bracket when support bar 70' is supported on the first mounting bracket. Support bar 70' further includes a second locking cap 92 on second end 76' of support bar 70' and abuts the wall-facing surface 32 of said second mounting bracket when support bar 70' is supported on the second mounting bracket.

As can also be seen in FIGS. 3 and 4, a locking pin, such as locking pin 96, can also be included on both ends of support bar 70'. Locking pins 96 serve the same purpose as locking pins 86 discussed above and thus will not be further discussed. As can also be seen in FIGS. 3 and 4, caps 90 and 92 also include fastener-receiving holes, such as hole 98 in cap 92.

To facilitate attachment of the support bar to the mounting brackets, the mounting brackets can include elements that will space the channels away from the wall on which the mounting bracket is fixed. Two such elements are shown in FIGS. 5 and 6, with spacer plates 100 and 102 being included with a mounting bracket in FIG. 5 and offset portions 104 and 106 being included with the mounting bracket shown in FIG. 6. Spacer plates 100 and 102 are shown in FIG. 5 as being elements that are separate from the monolithic mounting plate; however, these spacer elements can be one-piece with the remainder of the mounting bracket if suitable.

Still another form of the safety fixture can include a mounting flange 110 fixed to the elongate body 20 near the top end 22 thereof. Flange 110 includes a shower curtain rod receiving hole 112 defined therethrough to accommodate one end of a shower curtain rod to support that rod in place if desired. Each mounting bracket will include such a mounting flange so the shower curtain rod will be supported at both ends thereof. The mounting bracket thus will serve a dual purpose of being part of a support bar positioning system and being a shower curtain rod support element.

The use of the safety fixture of the present invention will occur to those skilled in the art based on the teaching of the present disclosure and thus will not be presented here in detail. It only being noted that the safety fixture includes mounting brackets which have a plurality of positions, in which a support bar can be supported, are fixedly mounted on walls adjacent to a tub or shower, and a support rod is moved into a position that is most efficient to the user and then is supported on the fixed mounting brackets in that chosen position. The support bar extends for the entire length of the tub or width of the shower and is located to be easily grasped by someone entering or exiting the tub or shower and includes a knurled outer surface and thus, once grasped, can be securely held.

It is understood that while certain forms of the present invention have been illustrated and described herein, it is not to be limited to the specific forms or arrangements of parts described and shown.

I claim:

1. A bath safety fixture comprising:

a) first and second mounting brackets which are fixedly mounted on a wall of a shower or bath when in use, each mounting bracket including (1) an elongate body having a top end, first and second side edges, a bottom end, an outer surface, a wall-facing surface, and a longitudinal centerline extending between said top and bottom ends of said elongate body of each mounting bracket, (2) at least one top end fastener-receiving hole defined through said elongate body from said outer surface to said wall-facing surface of each mounting bracket near said top end of said elongate body of each mounting bracket, (3) at least one bottom end fastener-receiving hole defined through said elongate body from said outer surface to said wall-facing surface of each mounting bracket near said bottom end of said elongate body of each mounting bracket, (4) a plurality of first channels extending through said elongate body from said outer surface to said wall-facing surface of said elongate body of each mounting bracket, each first channel including an entrance opening in said first side edge of said elongate body of each mounting bracket and a body portion extending from said entrance opening toward said second side edge of said elongate body of each mounting bracket at an oblique angle to said first side edge, and an exit opening located near said longitudinal centerline of said elongate body of each mounting bracket, said first channels being spaced apart from each other along said first side edge of said elongate body of each mounting bracket, (5) a plurality of second channels extending through said elongate body of each mounting bracket from said outer surface to said wall-facing surface of said elongate body of each mounting bracket, each second channel including an entrance end in open communication with an exit opening of a corresponding first channel, and a closed bottom end, each second channel extending in the direction of said longitudinal centerline of said elongate body of each mounting bracket, said second channels being spaced apart from each other along said longitudinal centerline of said elongate body;

b) a support bar extending from said first mounting bracket to said second mounting bracket when in use and including a first end supported on a closed bottom end of one of said second channels of said first mounting bracket and a second end supported on a closed bottom end of a corresponding one of said second channels of said second mounting bracket when in use, said support bar having a knurled outer surface, c) a first locking cap on said first end of said support bar and abutting said wall-facing surface of said first mounting bracket when said support bar is supported on said first mounting bracket;

d) a second locking cap on said second end of said support bar and abutting said wall-facing surface of said second mounting bracket when said support bar is supported on said second mounting bracket.

2. The bath safety fixture as described in claim 1 further including a plurality of fastener-receiving holes defined through each of said first and second locking caps.

3. The bath safety fixture as described in claim 1 further including a first locking pin receiving hole extending through the support bar near the first end of the support bar, and a second locking pin receiving hole extending through the support bar near the second end of the support bar; a first locking pin-accommodated in the first locking pin receiving hole on said support bar and abutting the wall-facing surface of said first mounting bracket when said support bar is supported on said first mounting bracket; and a second locking pin accommodated in the second locking pin receiving hole on said support bar and abutting the wall-facing surface of said second mounting bracket when said support bar is supported on said second mounting bracket.

* * * * *